US008733039B2

(12) United States Patent
Brandalík et al.

(10) Patent No.: US 8,733,039 B2
(45) Date of Patent: May 27, 2014

(54) SKYLIGHT WITH IMPROVED THERMAL INSULATION

(75) Inventors: Jakub Brandalík, Prague (CZ); Radek Soukup, Prague (CZ)

(73) Assignee: Lightway S.R.O., Prague (CZ)

( * ) Notice: Subject to any disclaimer, the term of this patent is extended or adjusted under 35 U.S.C. 154(b) by 0 days.

(21) Appl. No.: 13/700,547

(22) PCT Filed: May 30, 2011

(86) PCT No.: PCT/CZ2011/000060

§ 371 (c)(1),
(2), (4) Date: Nov. 28, 2012

(87) PCT Pub. No.: WO2011/150900

PCT Pub. Date: Dec. 8, 2011

(65) Prior Publication Data

US 2013/0086853 A1 Apr. 11, 2013

(30) Foreign Application Priority Data

May 31, 2010 (CZ) ..... 2010-433

(51) Int. Cl.
*E04B 7/18* (2006.01)

(52) U.S. Cl.
USPC ..... 52/200; 52/173.1

(58) Field of Classification Search
USPC ..... 52/200, 173.1, 171.1, 22, 199; 359/591, 359/599; 362/557
See application file for complete search history.

(56) References Cited

U.S. PATENT DOCUMENTS

| | | | | | |
|---|---|---|---|---|---|
| 4,339,900 | A * | 7/1982 | Freeman | 52/200 |
| 5,546,712 | A * | 8/1996 | Bixby | 52/200 |
| RE36,496 | E * | 1/2000 | Sutton | 52/200 |
| 6,256,947 | B1 * | 7/2001 | Grubb | 52/200 |
| 6,604,329 | B2 * | 8/2003 | Hoy et al. | 52/200 |
| 6,918,216 | B2 * | 7/2005 | Hoy et al. | 52/200 |
| 6,990,773 | B2 * | 1/2006 | Borges | 52/200 |
| 7,146,768 | B2 * | 12/2006 | Rillie | 52/200 |
| 7,954,281 | B2 * | 6/2011 | Jaster | 52/200 |

(Continued)

FOREIGN PATENT DOCUMENTS

| | | | | |
|---|---|---|---|---|
| EP | 1662063 | A2 * | 5/2006 | E04C 1/42 |
| GB | 2391025 | A * | 1/2004 | E04D 1/30 |
| JP | 2000075238 | A * | 3/2000 | G02B 27/00 |
| WO | WO 2007038590 | A1 * | 4/2007 | E04D 1/30 |

OTHER PUBLICATIONS

International Search Report for PCT/CZ2011/000060.

*Primary Examiner* — Brian Glessner
*Assistant Examiner* — Beth Stephan
(74) *Attorney, Agent, or Firm* — Notaro, Michalos & Zaccaria P.C.

(57) ABSTRACT

A skylight with improved thermal insulation includes a light tube which passes through a roof to bring daylight inside a building. The skylight conserves heat energy by providing a transparent, double paned insulation double glazing unit, which is positioned to divide the light tube into an upper tube and a lower tube. Insulation efficiency is maximized by providing the insulation double glazing unit, as well as an insulating foam collar the insulation unit is surrounded by and anchored to, in the same plane as the insulation in the ceiling of the building. The collar has a shape and thickness to match the span of ceiling or roof thermal insulation.

17 Claims, 2 Drawing Sheets

(56) References Cited

U.S. PATENT DOCUMENTS

2003/0066254 A1* 4/2003 DeBlock ..... 52/200
2005/0039410 A1 2/2005 Hoy et al.
2005/0166490 A1* 8/2005 Darmer et al. ..... 52/200
2005/0188629 A1* 9/2005 Rillie et al. ..... 52/200

* cited by examiner

SKYLIGHT WITH IMPROVED THERMAL INSULATION

FIELD OF THE INVENTION

The invention concerns skylights, especially roof skylights and light tubes where the light is carried in a tube from an input light collector to the inside of a building. An input light collector is typically placed on the roof, and the inside of the light carrying tube is equipped with a layer providing the best possible light reflection. At the point the skylight passes through the roof, the skylight is adapted to seal against humidity, and typically the tube is terminated at a diffuser inside the building.

BACKGROUND OF THE INVENTION

At present, skylights and light tubes used to carry light from a roof to areas within a building are known. Typically the entire inside surface of the tube is equipped with good light reflection. Various types of light collectors are provided at the tube input, usually dome-shaped, and made of resistant plastic material. Diffusers are usually placed at the tube output and are used for light diffusion to illuminate the inside area of the building. Efforts have been made to provide the best possible reflective surface at the inside surface of the light tube. There have also been efforts to develop ways to minimise light loss at the tube input and also at the tube output. As for heat loss, no special modifications to increase heat insulation are provided in the majority of skylights and light tubes of the type described above. Sometimes a thickened material layer and/or a doubled layer is provided at the tube input light collector or at the diffuser. Typically, the roof passage is designed only using a regular sealing material that surrounds the roof entrance point, and/or a flange is created in the light tube part, which serves as the roof passage. For sealing the light tube where it passes through the roof, structures or seals are used which are analogous to those used for sealing smokestack passages, ventilation pipelines, or air conduits.

However, an increased risk of imperfect sealing against humidity on the one hand and, on the other, excessive heat loss in general or failure to comply with efficiency standards regarding heat loss, still remain as disadvantages. Addressing these problems, especially the problem of heat loss, by choosing stronger or double walls both for the light collector at the tube input and for the diffuser at the light output from the tube, allows increased light absorption. However, none of the previous arrangements for improving heat insulation provide optimal efficiency, namely for the following reasons. Improved heat insulation at the diffuser still allows heat loss along the tube passage through the building, and so improved heat insulation must be implemented along the whole tube in the building. In this variant, the relatively colder inside area of the tube protrudes more into the building and thus increases the probability of vapour condensation on the lustrous, colder surface of the tube, which, however, worsens its light conduction characteristics significantly. Applying improved heat insulation at the light collector provides a relatively higher portion of the light tube with higher inside temperature, which, although limiting the risk of vapour condensation in the tube, still allows high heat loss because a part of the light tube, for example, between the last heat insulated ceiling and the roof, passes through a relatively colder area.

SUMMARY OF THE INVENTION

The aforementioned disadvantages are substantially resolved, and a lighting system with an optimized structure in terms of thermal insulation and reliable sealing against humidity, is obtained with the disclosed skylight. The present invention provides improved thermal insulation. The light tube consists of an input part including the light collector and an upper light tube, of the roof passage part, and of the lower light tube which includes the diffuser. The roof passage part contains an insulation double glazing unit. The insulation double glazing unit is fixed directly in a collar made of a foam insulation material, and includes at least one plastic anchoring holder that embraces the double glazing unit perimeter and extends, with at least some of its parts, above and below the insulation double glazing unit, and projects laterally toward the perimeter of the collar made of foam insulation material. Advantageously, the anchoring holder extends vertically up and down not more than up to 20 to 80% of the distance in which the collar extends above and below the insulation double glazing unit, and in terms of the perimeter, not more than up to 25 to 75% of the width of the collar made of the foam insulation material. Furthermore, it is beneficial if the heat passage coefficient of the light collector at the light tube input part, and also the heat passage coefficient of the diffuser at the light output from the lower light tube, are lower than the heat passage coefficient of the insulation double glazing unit of the roof passage part of the light tube. A sealing of the insulation double glazing unit in the collar against vapour passage between the lower light tube and upper light tube is advantageously provided. This insulation double glazing unit has round shape in the ground plan, which is another advantage. And yet another advantage can be obtained if the collar has rectangular shape in the ground plan, and at the same time, its thickness ranges between 10 and 30 cm.

This makes it possible to create a skylight and light tube where a high degree of thermal insulation is achieved, while at the same time providing a guarantee of high resistance against vapour condensation on the inside surface of the light tubes. At the same time, an insulation double glazing unit can be chosen to be based on glass with minimum light absorption, which is beneficial for high efficiency of light conduction. Also, the shape of the double glazing unit is planar, which is not at variance with the light function in this position, unlike the diffuser and particularly unlike the light collector where the convex shape is often opted for, which, especially with higher thickness of the material or with doubled walls, would be disadvantageous for light transmission.

When building a thus designed skylight and light tube in the roof and/or ceiling, it is advantageous that the essential thermal insulation element be in the light tube. Namely, the insulation double glazing unit is placed generally within the plane of the main thermal insulation of the ceiling part of the building. Further, its assembly can be easily connected in this thermal insulation plane to the collar mentioned above, which, in order to allow for such a connection, is shaped at its perimeter and also its thickness to correspond to the usual span of ceiling or roof thermal insulations.

BRIEF DESCRIPTION OF THE DRAWINGS

The presented invention is described further in more detail, and also explained using its preferred embodiment, and also using the attached drawings.

DETAILED DESCRIPTION OF PREFERRED EMBODIMENT

Figure 1:
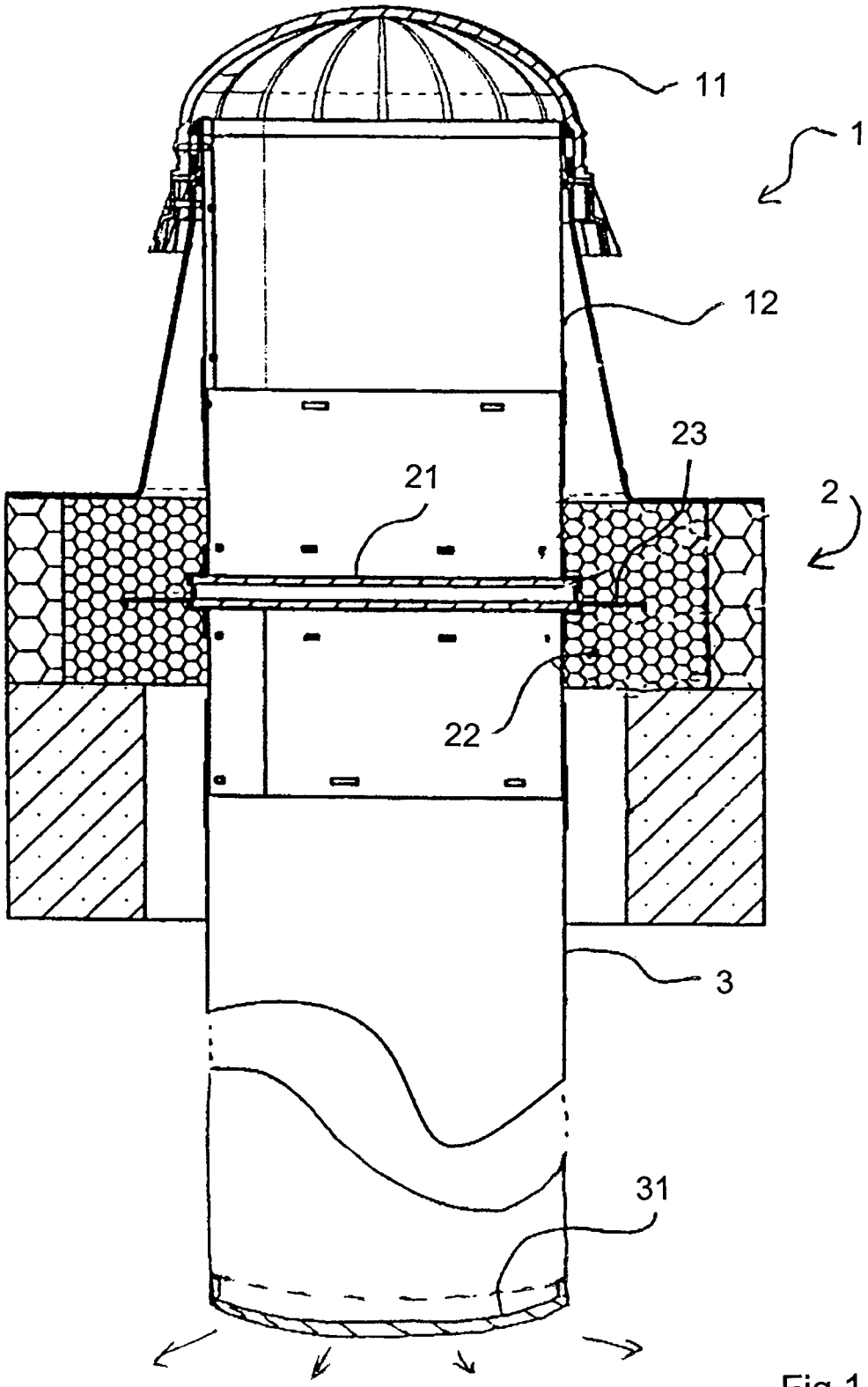
FIG. 1 shows the general situation of the installed skylight and light tube in its vertical cross-section.
Figure 2:
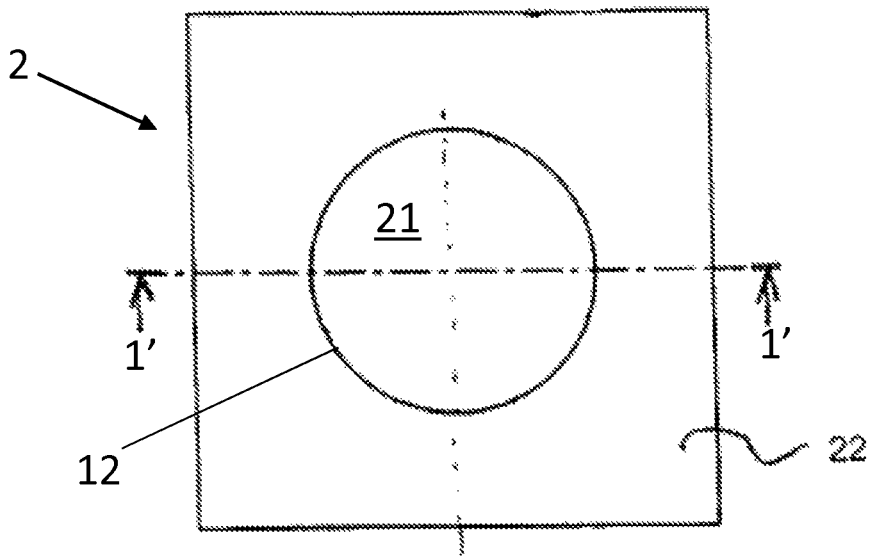
FIG. 2 shows a plan view of the roof passage part of the skylight assembly, with 1'-1' indicating the cross section shown in FIG. 1; and finally.
Figure 3:
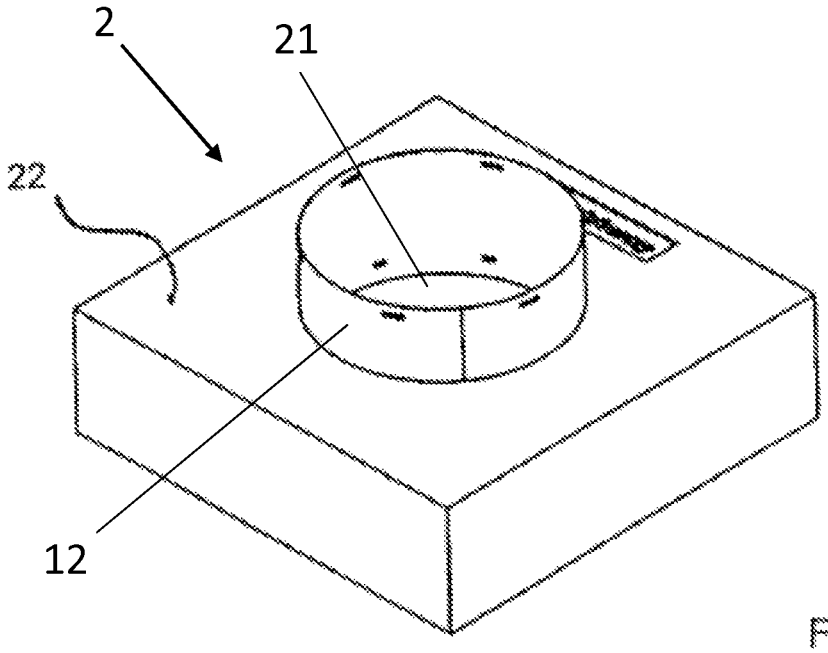
FIG. 3 shows the same roof passage part of the skylight as FIG. 2 in the axonometric perspective view.

A skylight having a light tube, built into a flat-roofed building, is described and shown herein as a sample embodiment. The light tube consists of its input part 1 with a light collector 11 and with the upper light tube 12, and also of the roof passage part 2 and the lower light tube 3 with the diffuser 31. An important fact is that the roof passage part 2 contains the insulation double glazing unit 21. This insulation double glazing unit 21 is fixed in a collar 22 made of injected foam insulation material, the insulation double glazing unit 21 being fixed in the collar 22 using a plastic anchoring holder 23 which embraces the perimeter of the insulation double glazing unit 21. The anchoring projections, not shown here in the detail, project above and below the insulation double glazing unit 21, and at the same time, project laterally toward the perimeter of the collar 22 made of the foam insulation material. The anchoring holder 23 is extended vertically up and down to 50% of the distance in which the collar 22 extends above and below the insulation double glazing unit 21, and in terms of the perimeter, it extends to 50% of the width of the collar 22 made of the foam insulation material.

The heat passage coefficient of the light collector 11 at the light input part 1 of the upper light tube 12 of the light tube, and the heat passage coefficient of the diffuser 31 at the light output from the lower light tube 3 of the light tube, is lower than the heat passage coefficient of the insulation double glazing unit 21 of the roof passage part 2 of the light tube. As regards the fixing in the foam polyurethane, the insulation double glazing unit 21 is sealed in the collar 22 against vapour penetration between the lower light tube 3 and the upper light tube 12 of the light tube.

Regarding the stress of the seating of the double glazing unit 21 in the collar 22, and especially in connection with the requirements for the sleeve piece strength of the roof passage part 2 in relation to the fastening of the upper light tube 12 and lower light tube 3, the insulation double glazing unit 21 can be dimensioned to project into the collar 22. The insulation double glazing unit 21 can have a square or round ground plan shape. The round shape is more complicated to produce, but provides material and weight savings. The round shape also beneficially reduces undesirable lateral light dispersion by only minimally exceeding the inner diameter of the light tube.

The collar 22, made of the foam insulation material, has a rectangular shape in the ground plan, or more specifically a square shape. Its thickness is 26 cm, which allows for good assembly connection to the surrounding thermal insulation of the roof, including any beams or battens.

In general, the thus optimized structure of the skylight and light tube shows improved characteristics compared to the current state of the art, based on comparison of the heat passage coefficients, as well as in respect of the distribution of temperatures, humidity values, and tendency for humidity condensation in individual parts of the light tube.

INDUSTRIAL APPLICABILITY

A skylight and light tube designed in accordance with the presented invention can be built into structures where it is desirable to bring in daylight, such as to areas where daylight illumination is insufficient or where it is not present at all. At the same time, this device also provides heat energy savings. From a legislative point of view, this device helps achieve compliance with standards for heat passage in buildings and their structural elements.

The invention claimed is:

1. A thermally insulating skylight (1), the skylight comprising:

a light tube defining a pathway for passing light from the outside of a structure through a roof to the inside of the structure, the light tube comprising: an input part (1) having a light collector (11) for collecting outdoor light and also an upper tube (12); a roof passage part (2); and a lower tube (3) leading to a diffuser (31);

wherein the roof passage part is positioned between the upper tube and the lower tube, the roof passage part (2) being for passing light received from the input part (1) through a roof;

wherein the roof passage part comprises an insulation double glazing unit (21), the insulation double glazing unit being a thermally insulating physical barrier positioned between the input part (1) and the lower tube (3), the insulation double glazing unit (21) comprising light permeable material for allowing passage of light there through; and the roof passage part further comprising a collar (22), the collar (22) comprising foam insulation material and surrounding the insulation double glazing unit (21), the insulation double glazing unit being fixed in the collar by an anchoring holder (23), the collar being for positioning within a roof.

2. The thermally insulating skylight of claim 1:

wherein the light collector (11), the diffuser (31), and the insulation double glazing unit (21) each have a respective heat passage coefficient, and wherein the light collector (11) and the diffuser (31) both have lower heat passage coefficients than the insulation double glazing unit (21).

3. The thermally insulating skylight of claim 1, wherein the anchoring holder (23) is attached to the perimeter of the insulation double glazing unit (21), and projects laterally towards the perimeter of the collar (22).

4. The thermally insulating skylight of claim 3, wherein the anchoring holder (23) extends out laterally between 25% and 75% of the distance from the perimeter of the insulation double glazing unit (21) to the perimeter of the collar (22).

5. The thermally insulating skylight of claim 1, wherein the insulation double glazing unit (21) is generally planar, and wherein at least some portions of the anchoring holder (23) extend vertically above and below the plane of the insulation double glazing unit (21).

6. The thermally insulating skylight of claim 5:

wherein the collar (22) extends both above and below the plane of the insulation double glazing unit; and wherein said portions of the anchoring holder (23) which extend vertically above and down below the plane of the insulation double glazing unit (21) extend between 20% and 80% of the distance the collar (22) extends above or below the plane of the insulation double glazing unit (21) in that respective location.

7. The thermally insulating skylight of claim 1, wherein the insulation double glazing unit (21) is generally planar.

8. The thermally insulating skylight of claim 1, wherein the insulation double glazing unit (21) is generally planar, and comprises two mutually parallel glass elements spanning across the light tube.

9. The thermally insulating skylight of claim 1, wherein the light tube has an inner surface, and the inner surface comprises a reflective layer.

10. The thermally insulating skylight of claim 1, wherein the collar (22) is either square or rectangular in the plan view.

11. The thermally insulating skylight of claim 1, wherein the collar (22) and the insulation double glazing unit (21) collectively provide a seal against vapor passage between the lower tube (3) and the upper light tube (12).

12. A roof comprising the thermally insulating skylight of claim 11, wherein the roof comprises a layer of thermal insulation, and wherein the insulation double glazing unit (21) is positioned within the plane of the thermal insulation layer in the roof.

13. The roof comprising a thermally insulating skylight of claim 12, wherein the collar (22) has a shape which compliments the shape of the surrounding layer of thermal insulation in the roof.

14. The roof comprising a thermally insulating skylight of claim 12, wherein the collar (22) has a square or rectangular shape when viewed from above.

15. The roof comprising a thermally insulating skylight of claim 12, wherein the collar (22) is connected to thermal insulation in the roof.

16. The roof comprising a thermally insulating skylight of claim 12, wherein the light collector (11), the diffuser (31), and the insulation double glazing unit (21) each have a respective heat passage coefficient, and wherein the light collector (11) and the diffuser (31) both have lower heat passage coefficients than the insulation double glazing unit (21).

17. The roof comprising a thermally insulating skylight of claim 12, wherein the collar (22) and the insulation double glazing unit (21) collectively provide a seal against vapor passage between the lower tube (3) and the upper light tube (12).

* * * * *